US011447903B2

(12) United States Patent
Honda et al.

(10) Patent No.: US 11,447,903 B2
(45) Date of Patent: Sep. 20, 2022

(54) SEWING MACHINE PRESSER FOOT

(71) Applicant: JANOME SEWING MACHINE Co., Ltd., Hachioji (JP)

(72) Inventors: Koichi Honda, Hachioji (JP); Yukitaka Omata, Hachioji (JP)

(73) Assignee: JANOME CORPORATION, Hachioji (JP)

( * ) Notice: Subject to any disclaimer, the term of this patent is extended or adjusted under 35 U.S.C. 154(b) by 0 days.

(21) Appl. No.: 17/129,287

(22) Filed: Dec. 21, 2020

(65) Prior Publication Data

US 2021/0301441 A1 Sep. 30, 2021

(30) Foreign Application Priority Data

Mar. 26, 2020 (JP) ..... JP2020-055689

(51) Int. Cl.
*D05B 29/10* (2006.01)

(52) U.S. Cl.
CPC ..... *D05B 29/10* (2013.01)

(58) Field of Classification Search
CPC ..... D05B 29/00–12
See application file for complete search history.

(56) References Cited

U.S. PATENT DOCUMENTS 2,979,745 A * 4/1961 Schaefer, Jr. ..... A43D 43/02 12/55
3,080,836 A * 3/1963 Harruff ..... D05B 35/102 112/47
3,582,064 A * 6/1971 Weidman ..... B65H 3/46 271/19
5,540,164 A * 7/1996 Grantham ..... D05B 35/102 112/306
6,973,886 B2 * 12/2005 Marcangelo ..... A47C 27/003 112/139

FOREIGN PATENT DOCUMENTS

DE 2404468 A * 8/1975
JP H01-062779 U 4/1989
JP H06-013770 U 2/1994

* cited by examiner

*Primary Examiner* — Ismael Izaguirre
(74) *Attorney, Agent, or Firm* — McGinn IP Law Group, PLLC

(57) ABSTRACT

A sewing machine presser foot includes a support part having a support base member, and a roller part including a plurality of rotating members rotatably supported at the support base member and having different diameters so that the roller part is conical as a whole. Each of the plurality of rotating members individually rotates and presses a fabric to be sewn.

4 Claims, 7 Drawing Sheets

Fig.3A
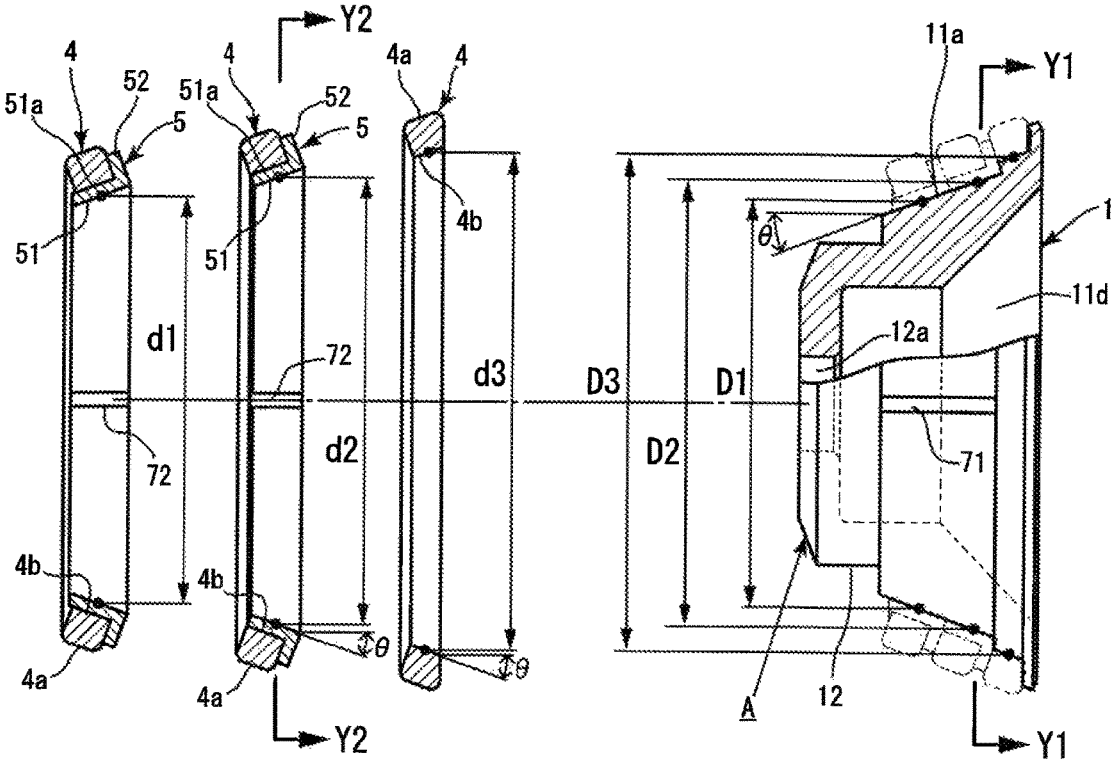
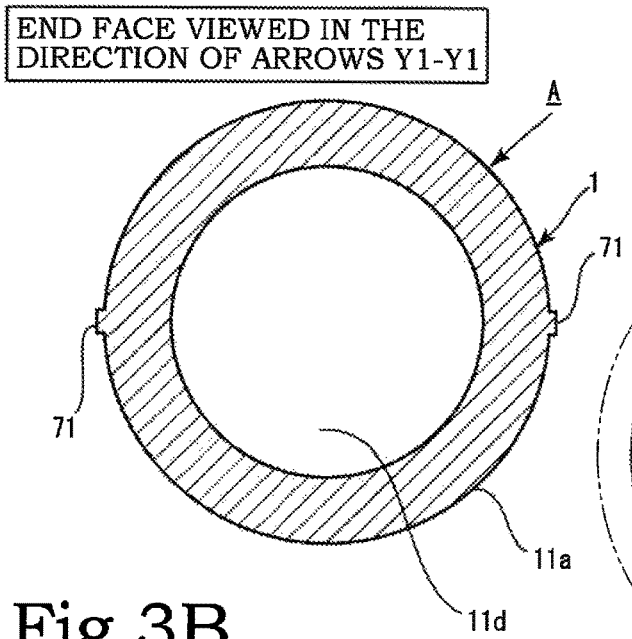
Fig.3B
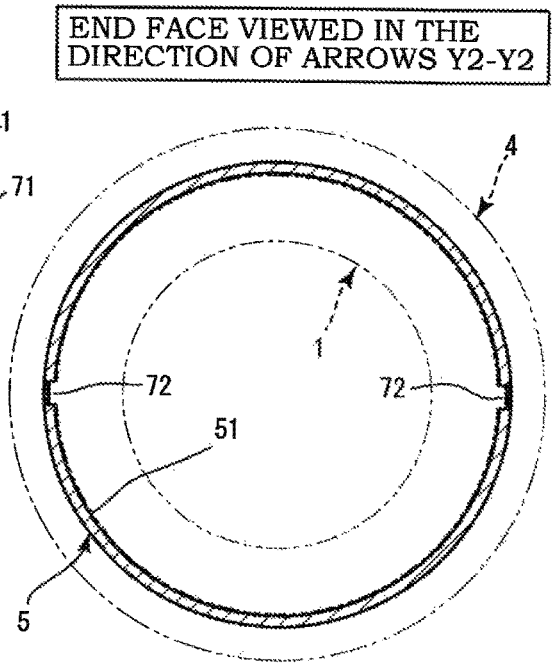
Fig.3C

SEWING MACHINE PRESSER FOOT

BACKGROUND OF THE INVENTION

1. Field of the Invention

The present invention relates to a sewing machine presser foot having a conical side face tilted for pressing down fabric such as cloth, leather, and vinyl, and suited not only to an originally intended purpose of curve sewing but also to straight sewing.

2. Description of the Related Art

There are various types of sewing machine presser feet each suited to specific way of sewing. One of these presser feet is a roller type presser foot that has a conical outer circumferential side face as disclosed in Japanese Utility Model Applications Laid-open No. H01-62779 and Japanese Utility Model Applications Laid-open No. H06-13770. This type of presser foot is designed to have a structure suited particularly for curve sewing.

SUMMARY OF THE INVENTION

As noted above, the roller-type presser foot that has a conical outer circumferential side face is specifically designed for curve sewing. To the contrary, it is not suited to straight sewing. Namely, the presser foot in the shape of a conical roller is not suitable for sewing straight stitches since the roller has different outer diameters at each position along the axial direction of the roller. The conical roller presser foot of each of Japanese Utility Model Applications Laid-open No. H01-62779 and Japanese Utility Model Applications Laid-open No. H06-13770 has, specifically, the largest outer diameter at the right end that is closest to the sewing machine needle, and the smallest outer diameter at the left end that is farthest from the sewing machine needle.

When a straight stitch is sewn with such a conical roller, the feed amount differs between respective points of pressing down the fabric. This results in wrinkling in the fabric, which makes favorable sewing impossible, i.e., it is extremely unsuitable for straight sewing. Accordingly, an object of the present invention is to provide a sewing machine presser foot that is not only suited to curve sewing but also favorably applicable to straight sewing while using a conical roller.

As a result of elaborate studies conducted by the inventors for solving the above problem, a first aspect of the present invention is a sewing machine presser foot including: a support part having a support base member; and a roller part including a plurality of rotating members rotatably supported at the support base member and having different diameters so that the roller part is conical as a whole, each of the plurality of rotating members individually rotating and pressing a fabric to be sewn, whereby the above problem is solved.

A second aspect of the present invention is the sewing machine presser foot according to the first aspect, wherein the rotating members each include a protruding piece that is able to slide and abut on the rotating member adjacent thereto, whereby the above problem is solved.

A third aspect of the present invention is the sewing machine presser foot according to the first aspect, further including an intermediate support member provided between the rotating members that are adjacent to each other, whereby the above problem is solved.

A fourth aspect of the present invention is the sewing machine presser foot according to the first aspect, wherein the support base member has a conical or rod-like shape, whereby the above problem is solved. A fifth aspect of the present invention is the sewing machine presser foot according to the second aspect, wherein the support base member has a conical or rod-like shape, whereby the above problem is solved. A sixth aspect of the present invention is the sewing machine presser foot according to the third aspect, wherein the support base member has a conical or rod-like shape, whereby the above problem is solved.

In the present invention, the sewing machine presser foot includes: a support part having a support base member; and a roller part including a plurality of rotating members rotatably supported at the support base member and having different diameters so that the roller part is conical as a whole, each of the plurality of rotating members individually rotating and pressing a fabric to be sewn.

Since the plurality of rotating members can each rotate independently, the presser foot, which is originally intended for the purpose of curve sewing, is also applicable to straight sewing because it is possible, with the plurality of rotating members discretely rotatable, to make the outer circumferential speed of each rotating member equal along the direction of the straight stitch. Accordingly, straight stitches can be sewn favorably without wrinkling of the fabric.

BRIEF DESCRIPTION OF THE DRAWINGS

FIG. 3A is a partially cut-out cross-sectional view illustrating rotating members, intermediate support members, and a support base member in the first embodiment of the present invention separated from each other, FIG. 3B shows an end face of FIG. 3A as viewed in the direction of arrows Y1-Y1, and FIG. 3C shows an end face of FIG. 3A as viewed in the direction of arrows Y2-Y2;

DESCRIPTION OF THE PREFERRED EMBODIMENTS

Figure 1A:
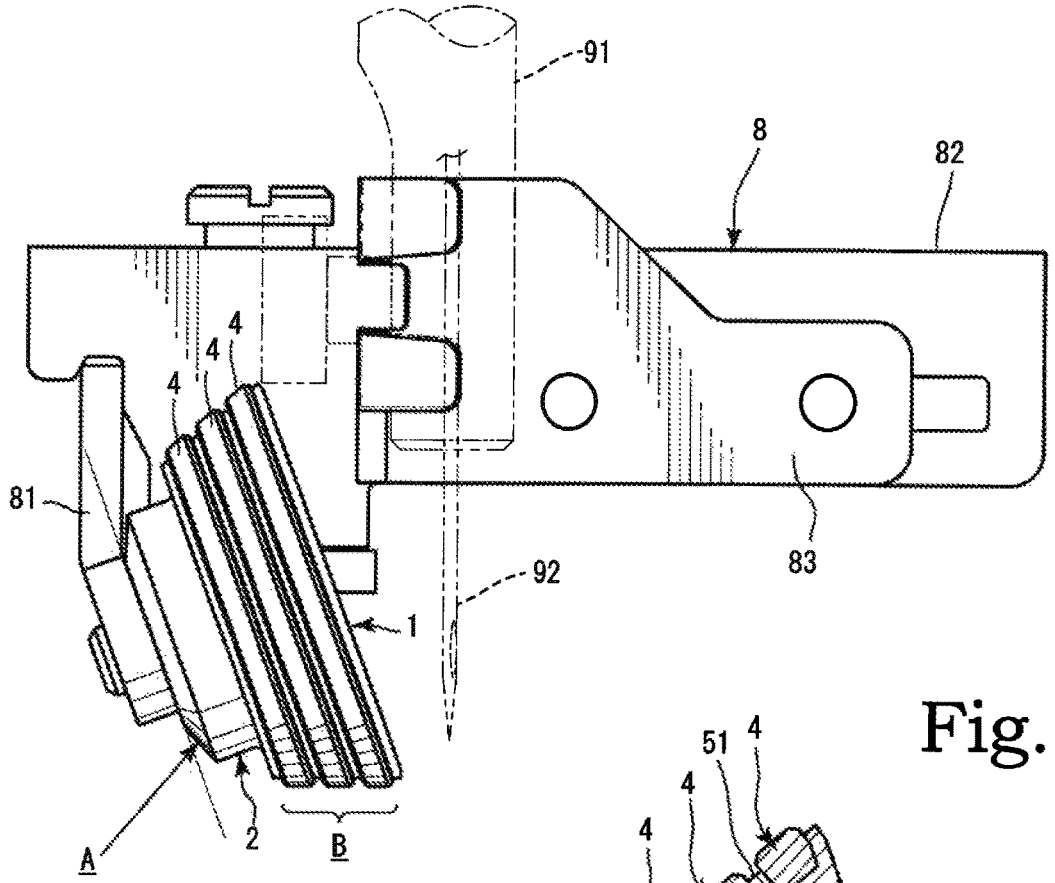
FIG. 1A is a side view of a presser foot attached to a shank 8 in a first embodiment of the present invention.

Hereinafter, embodiments of the present invention will be described with reference to the drawings. The present invention includes several embodiments. A first embodiment is described first with reference to FIG. 1A to FIG. 3C. The present invention in the first embodiment is mainly composed of a support part A and a roller part B. A shank 8 would further be necessary for attaching the presser foot of the present invention to a presser foot rod 91 of the sewing machine (see FIG. 6A and FIG. 6B).

The support part A has a support base member 1 and a casing member 2 (see FIG. 1A, FIG. 1B, FIG. 2A and FIG. 2B). The support base member 1 is conical as a whole and has a conical outer circumferential surface 11*a* on the outer circumference (see FIG. 2A and FIG. 2B). The conical support base member 1 has a cup-like hollow part 11*d* inside (see FIG. 1B, FIG. 2A and FIG. 2B). A coupling part 12 is formed in a flat cylindrical shape at one end of the support base member 1. Inside the cup-like hollow part 11*d* are conical and cylindrical cavities continuous with each other. A coupling hole 12*a* is formed at the center of the coupling part 12 for a fastener 14 such as a screw to be inserted (see FIG. 2A and FIG. 2B).

Figure 1B:
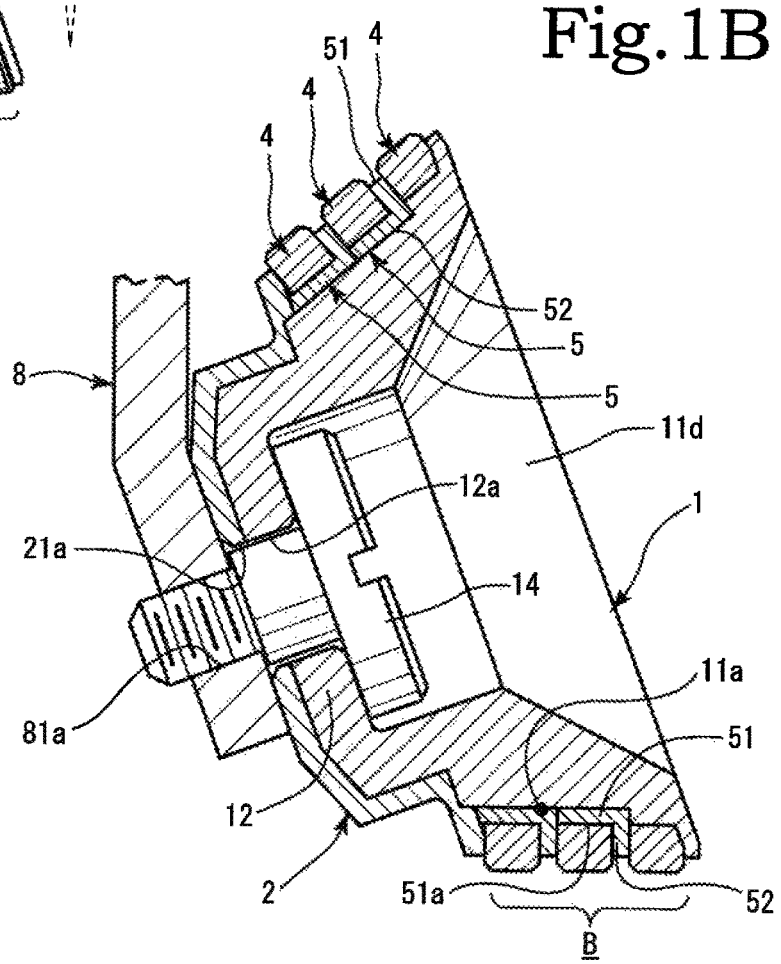
FIG. 1B is a longitudinal cross-sectional side view showing a cross section of part of the first embodiment of the present invention.

The casing member 2 serves the function of stably encasing rotating members 4 that form the roller part B attached to the conical support base member 1 and of implementing attachment to an arm 81 of the shank 8 (see FIG. 1B). The casing member 2 includes a flat cylindrical connecting part 21 and an annular flange 22 formed along the outer peripheral edge of the connecting part 21 (see FIG. 2A and FIG. 2B).

A coupling hole 21*a* is formed at the center in the bottom of the connecting part 21 so that the casing member is coupled to the support base member 1 and the arm 81 of the shank 8 with the fastener 14 such as a screw. The flange 22 serves the function of retaining the rotating members 4 attached to the conical outer circumferential surface 11*a* of the conical support base member 1 to stay thereon (see FIG. 1B). The casing member 2 is at the base of the support part A when the support part A is attached to the shank 8. The support base member 1 is the part in close proximity to a sewing machine needle 92 (see FIG. 6A and FIG. 6B). The support base member 1 and casing member 2 of the support part A are made of metal or synthetic resin.

The roller part B is made up of a plurality of rotating members 4 put together in the axial direction (see FIG. 1A, FIG. 1B, FIG. 2A and FIG. 2B). The plurality of rotating members 4 have different diameters and axially aligned in the order from the smallest to the largest in diameter stepwise along their axial direction (see FIG. 1A, FIG. 1B, FIG. 2A, FIG. 2B, FIG. 3A and others).

The axial direction here means the direction along the line of the axial core of the threaded rod of the fastener 14 mentioned above and shall be used to indicate the same direction for both of the support part A and the roller part B. The rotating members 4 are thin, ring-like members with a small thickness and width (see FIG. 3C). The cross-sectional shape of the rotating members 4 of a plane orthogonal to the circumferential direction is substantially quadrate. The outer circumferential side face 4*a* forms a circular side face of a cone (see FIG. 3A, FIG. 3B, FIG. 3C).

Figure 2A:
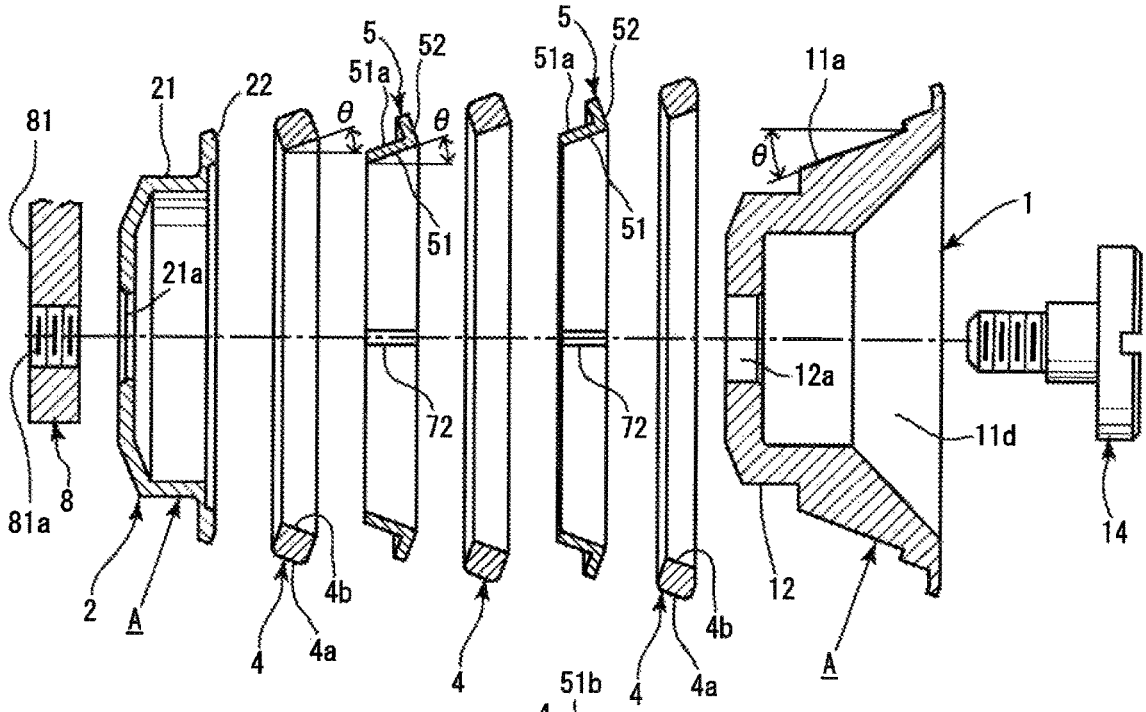
FIG. 2A is a partially cross-sectional exploded side view of the first embodiment of the present invention.
Figure 2B:
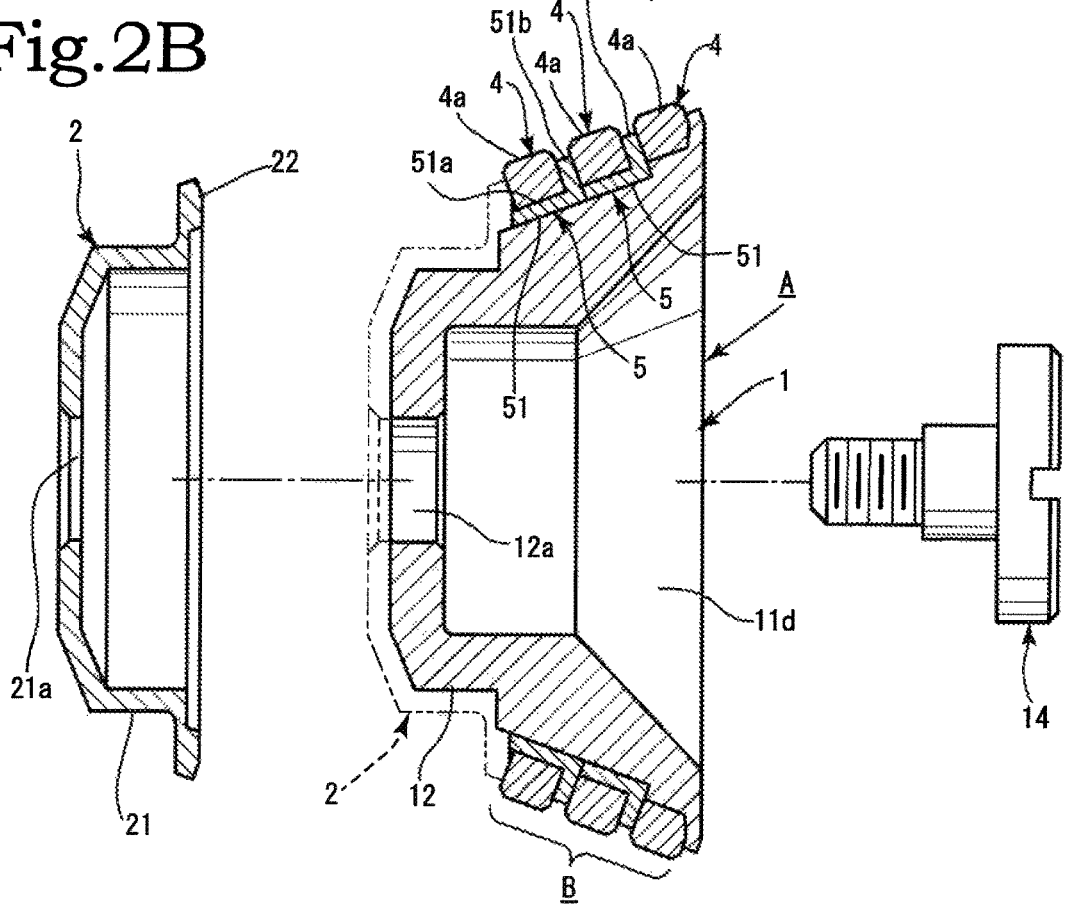
FIG. 2B is an enlarged cross section of major parts of FIG. 2A.

The roller part B made up of the plurality of such rotating members 4 is attached to the support base member 1 of the support part A (see FIG. 1A, FIG. 1B and FIG. 2B). The plurality of rotating members 4 forming the roller part B are attached to the conical support base member 1 in the order in which the diameter of the outer circumferential side face 4*a* increases stepwise. Specifically, the diameter of the outer circumferential side face 4*a* increases stepwise from one end of the support part A closer to the casing member 2 toward the support base member 1 so that the plurality of rotating members 4 together form a substantially conical ring.

Figure 6A:
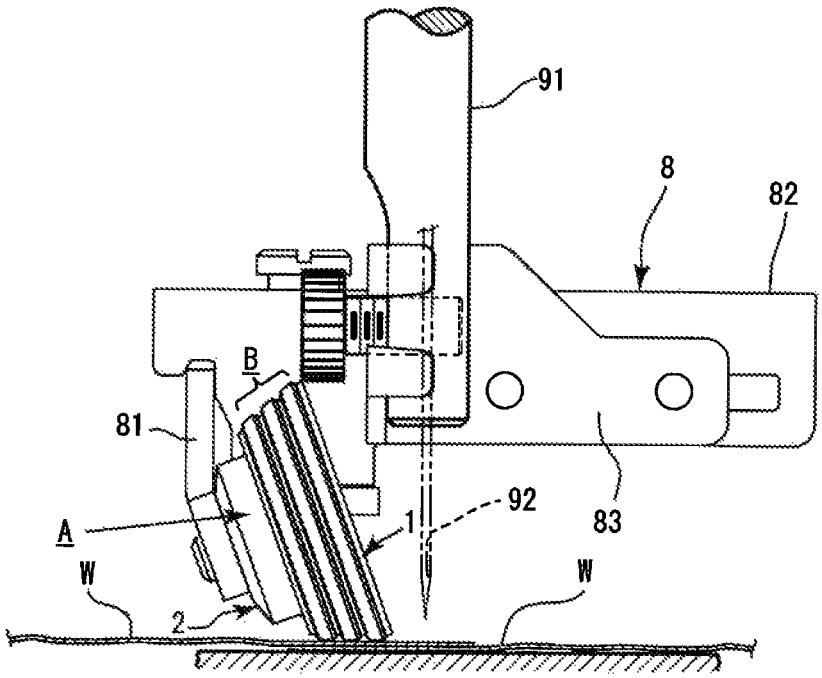
FIG. 6A shows a presser foot attached to a presser foot rod of a sewing machine in the first embodiment of the present invention as viewed from the front of the sewing machine.
Figure 6B:
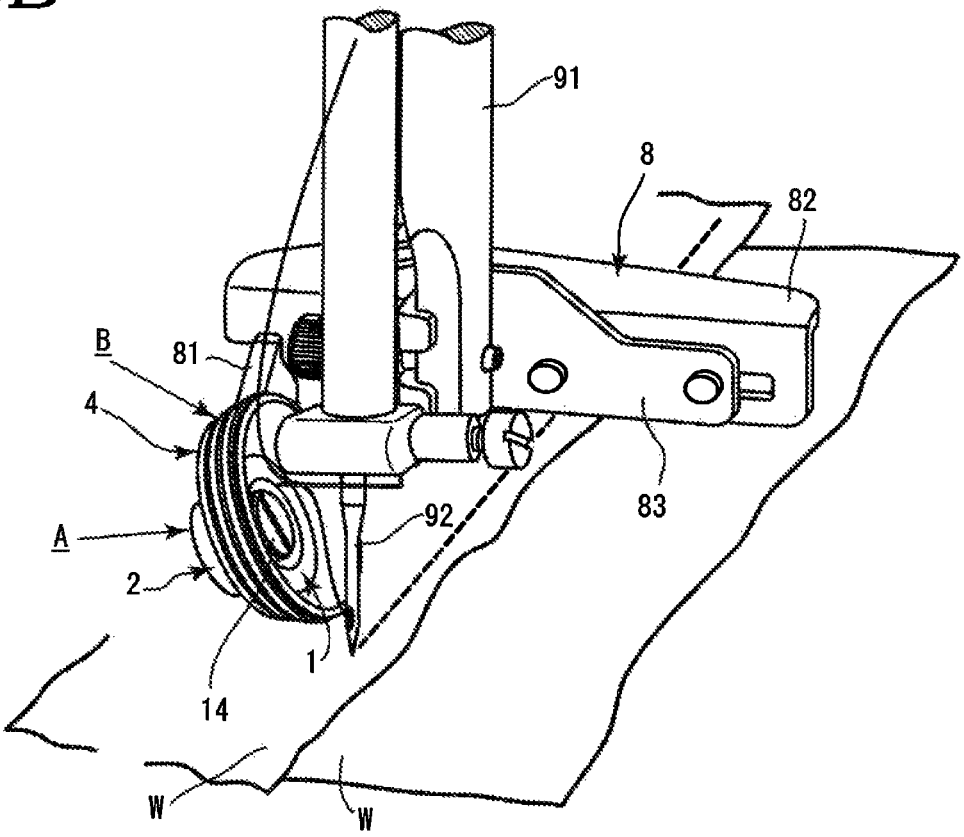
FIG. 6B is a perspective view of the presser foot of the first embodiment attached to the presser foot rod of the sewing machine as viewed from the front of the sewing machine.

To put it differently, the diameters of the plurality of rotating members 4 increase stepwise from a point farthest from the sewing machine needle 92 toward a closest point when the sewing machine presser foot of the present invention is attached to the shank 8 so that a substantially conical ring is formed (see FIG. 6A and FIG. 6B). Namely, the rotating member 4 with the largest outer diameter is disposed closest to the sewing machine needle 92, and the rotating member 4 with the smallest outer diameter is disposed farthest from the sewing machine needle 92 (see FIG. 6A and FIG. 6B). The plurality of rotating members 4 are configured to each rotate independently. The rotating members 4 are made of metal or synthetic resin. The rotating members 4 are preferably made of metal in particular, since they rotate in contact with the fabric to be sewn W and are required to be durable. The outer circumferential side face 4*a* of the rotating member 4 may have a smooth surface, or may have a knurled or otherwise processed surface.

Intermediate support members 5 are provided between the support base member 1 and the rotating member 4 or between adjacent rotating members 4, and serve the function of causing the rotating members 4 to smoothly rotate at the predetermined positions without axially shifting relative to the conical support base member 1 (see FIG. 1B and FIG. 2B). A plurality of intermediate support members 5 are provided in accordance with the number of the rotating members 4. The intermediate support members 5 are ring-like in shape and include a seat part 51 and a divider part 52. The intermediate support member has a substantially L-shaped cross section in a plane orthogonal to the circumferential direction because of these seat part 51 and divider part 52. (see FIG. 2A)

The divider parts 52 of the intermediate support members 5 are positioned between the adjacent ones of the plurality of rotating members 4 attached to the support base member 1 (see FIG. 1B). Namely, the divider parts 52 serve the function of keeping the adjacent rotating members 4 apart and out of contact with each other and of preventing them from mutually interfering their rotating movement. The seat parts 51 of the intermediate support members 5 are disposed on conical outer circumferential surface 11*a* of the conical support base member 1. The divider parts 52 of the intermediate support members 5 are at right angles to the conical outer circumferential surface 11*a* of the conical support base member 1 (see FIG. 1B and FIG. 2B).

The conical support base member 1 is in the shape of a cone, with the conical outer circumferential surface 11*a* having an inclination angle of θ relative to the axial core along the axial direction. The intermediate support members 5 are attached to the support base member 1 as described above, and serve the function of a bearing to enable each of the plurality of rotating members 4 to rotate smoothly.

The inner circumferential surface 51*a* of the seat parts 51 of the plurality of intermediate support members 5 has an inner diameter of either d1 or d2 (see FIG. 3A). The inner diameter d1 and the inner diameter d2 of the intermediate support members 5 differ from each other, d2 being larger than d1. The inner circumferential surface 51*a* of the intermediate support member 5 is inclined along its axial direction, at an angle equal to the inclination angle θ of the conical outer circumferential surface 11*a* (see FIG. 2A and FIG. 3A).

The intermediate support members 5 having different diameters are set at predetermined positions on the conical support base member 1. The conical support base member 1 has predetermined points with an outer diameter D1 and an outer diameter D2 along the axial direction corresponding to the inner diameter d1 and the inner diameter d2 of the inner circumferential surface 51*a* of the intermediate support member 5 (see FIG. 3A). Here, the inner diameter d1 and the inner diameter d2 of the inner circumferential surfaces 51*a* of the intermediate support members 5 are inner diameters of the axial intermediate positions that are assumed to be the mean values of diameters of the conical inner circumferential surface.

Thus, when the intermediate support members 5 are attached on the conical support base member 1, the intermediate support member 5 having the inner diameter d1 is secured to the point on the conical support base member 1 with the outer diameter D1. Similarly, the intermediate support member 5 having the inner diameter d2 is secured to the point on the conical support base member 1 with the outer diameter D2 (see FIG. 3A).

The intermediate support member 5 is disposed between the rotating member 4 and the conical support base member 1, and serves the function of a bearing for the rotating member 4 as described above. Therefore, the intermediate support members 5 are attached firmly to the conical support base member 1 such as not to be able to rotate. The outer diameter of the seat part 51 of the intermediate support member 5 is defined by the corresponding one of different radially inner diameters of the rotating members 4.

The inner circumferential side face 4*b* of the rotating member 4 is disposed on the outer circumferential side face of the seat part 51 of the intermediate support member 5 such as to be rotatable, and the intermediate support member 5 with the rotating member 4 attached thereto is disposed on the conical support base member 1 (see FIG. 2B). The rotating member 4 with the largest diameter and the intermediate support member 5 are attached to the conical support base member 1 at a point where the outer diameter thereof is largest in the axial direction, in other words the point closest to the sewing machine needle 92, and the rotating members 4 and intermediate support members 5 are attached in the order from the larger to the smaller in diameter stepwise.

The same number of intermediate support members 5 may be provided as the number of the rotating members 4, but the numbers need not necessarily be the same. For example, the rotating member 4 positioned outermost in the axial direction on the conical support base member 1 can be rotatably attached directly on the conical support base member 1 without the intermediate support member 5 (see FIG. 1B, FIG. 2A and FIG. 2B). In this case, the inner diameter d3 of the annular inner circumferential side face 4*b* of the rotating member 4 corresponds to the outermost outer diameter D3 of the conical support base member 1 such that the rotating member is rotatable.

Since the intermediate support members 5 serve the function of a bearing for the rotating members 4, the intermediate support members 5 themselves are secured on the conical support base member 1 so that they do not rotate relative to the support base member 1. Specifically, locking protrusions 71 and locking grooves 72 are formed between the conical support base member 1 and the seat part 51 of the intermediate support member 5. More specifically, the locking protrusions 71 are protruded in shape, while the locking grooves 72 are in the form of grooves the locking protrusions 71 can fit in, so that they lock each other (see FIG. 3A, FIG. 3B and FIG. 3C).

In the embodiment of FIG. 3A, FIG. 3B and FIG. 3C, the locking protrusions 71 are formed straight along the axial direction on the conical support base member 1, and groove-like locking grooves 72 are formed in the inner circumferential side faces of the intermediate support members 5. The locking grooves 72 are formed in the inner circumferential side faces of the seat parts 51 if the intermediate support members 5 have the seat parts 51. When there are no seat parts 51 and the intermediate support members 5 are formed solely by the divider parts 52, the locking grooves 72 are formed in the inner circumferential side faces of the divider parts 52. The locking protrusions 71 and locking grooves 72 locking each other secure the intermediate support members 5 on the conical support base member 1 such as not to rotate.

The intermediate support members 5 and rotating members 4 are thus attached on the conical support base member 1 in the order from the smallest to the largest in outer diameter of the rotating members 4. Normally, the rotating member 4 with the smallest diameter is disposed farthest from the sewing machine needle 92, and the rotating member 4 with the largest diameter is disposed closest to the sewing machine needle 92, as illustrated in FIG. 1A, FIG. 1B, FIG. 6A, FIG. 6B and others. The intermediate support members 5 are made of metal or synthetic resin.

Considering their function as a bearing for the rotating members 4, in particular, the intermediate support members 5 are preferably made of a material that allows for smooth rotation of the rotating members 4. The outer circumferential side face of the seat part 51 and the surface of the divider part 52 of the intermediate support members 5, which make contact with the rotating member 4, are each preferably a smooth surface with an extremely low friction coefficient. Accordingly a synthetic resin material is particularly favorable for the intermediate support members 5. In the case where the intermediate support members 5 are made of metal, the surface is preferably treated to increase smoothness.

As noted above, the intermediate support member 5 is disposed between the rotating member 4 and the conical support base member 1, and serves the function of a bearing to enable the rotating member 4 to rotate smoothly. Specifically, the intermediate support members 5 are secured to the support base member 1 and cannot rotate, while the rotating members 4 rotate relative to the intermediate support members 5. The plurality of rotating members 4 in the roller part B are disposed on the conical support base member 1 in the order from the smallest to the largest in diameter to form a conical shape.

All of the plurality of rotating members 4 make contact with the fabric to be sewn W and rotate simultaneously during the sewing. When a straight stitch is sewn, of the plurality of the rotating members 4, the rotating member 4 with the smallest diameter rotates at a highest rotation speed, while the rotating member 4 with the largest diameter rotates with a lowest rotation speed. As illustrated in FIG. 1A and FIG. 1B, when there are three rotating members 4 that form the roller part B, the rotating member 4 with the smallest diameter that is disposed farthest from the sewing machine needle 92 rotates at a highest rotation speed, and the rotating member 4 disposed closest to the sewing machine needle 92 rotates with a lowest rotation speed.

The intermediate support members 5 and rotating members 4 are attached on the support base member 1, and the casing member 2 is connected to the support base member 1, with the circular bowl-like connecting part 21 covering the coupling part 12. The threaded rod of the fastener 14 such as a screw is then passed through the coupling hole 12*a* of the support base member 1 and the coupling hole 21*a* of the casing member 2 to secure the support base member and casing member to the shank 8 (see FIG. 1A and FIG. 1B).

Figure 4A:
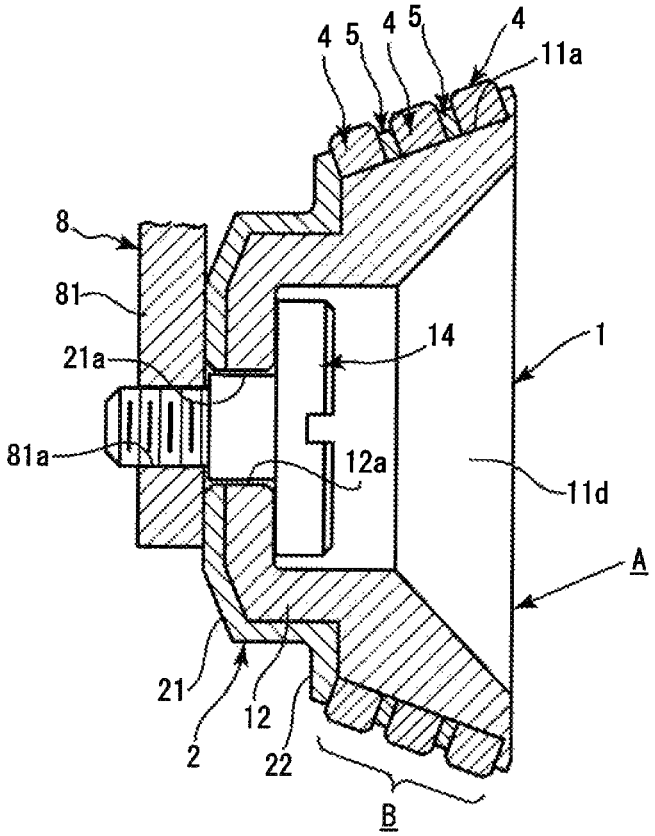
FIG. 4A is a partially cross-sectional side view of a first variation example of the first embodiment of the present invention.
Figure 4B:
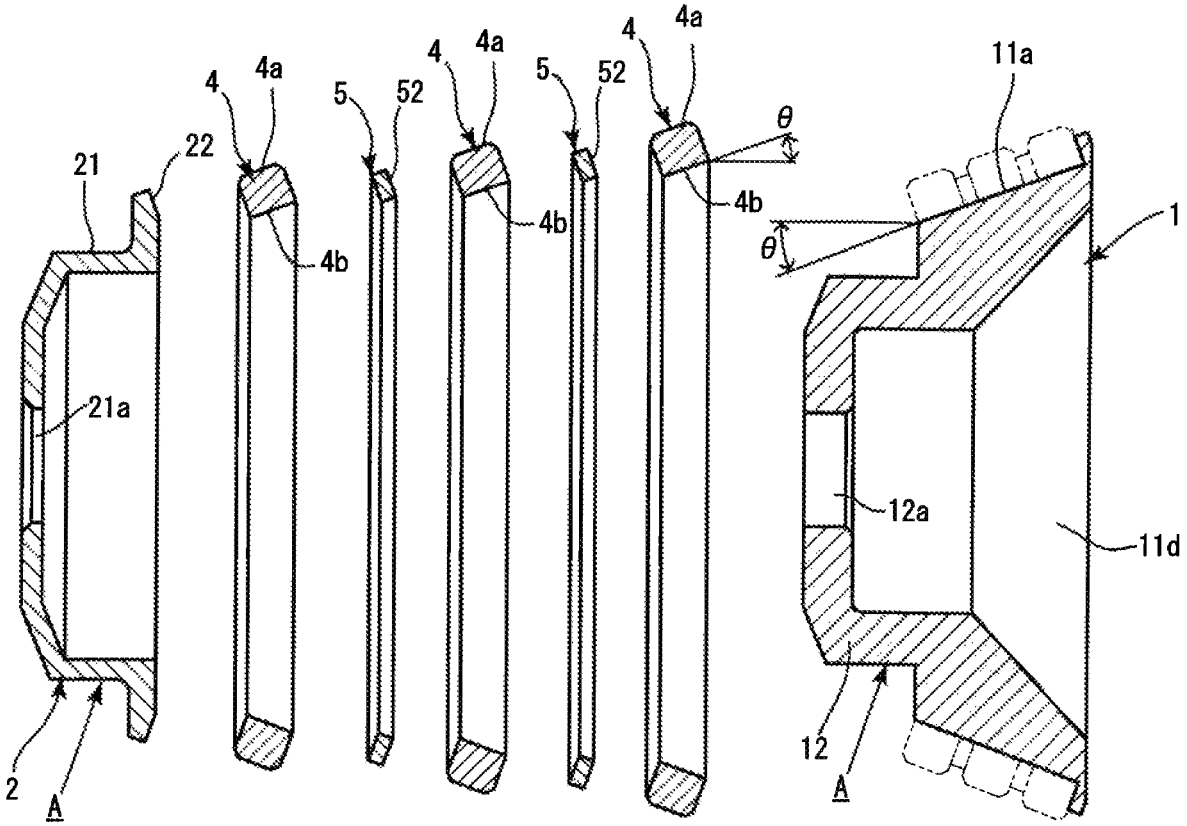
FIG. 4B is an exploded longitudinal cross-sectional side view of the first variation example of the first embodiment of the present invention.

There are variation examples in the first embodiment (see FIG. 4A, FIG. 4B, FIG. 5A, FIG. 5B and FIG. 5C). In the first variation example of the first embodiment, as illustrated in FIG. 4A and FIG. 4B, the intermediate support members 5 are formed only of the divider parts 52 and do not include the seat parts 51. Therefore the divider parts 52 alone are disposed between the rotating members 4 and the conical support base member 1 (see FIG. 4B).

Namely, the rotating members 4 are attached on the conical support base member 1 rotatably, with the inner circumferential side faces 4*b* in direct contact with the conical outer circumferential surface 11*a*. In this variation example of the first embodiment, the intermediate support members 5 that have only the divider parts 52 keep the adjacent rotating members 4 out of contact with each other by the divider parts 52 and prevent them from interfering each other's rotation (see FIG. 4A).

Figure 5A:
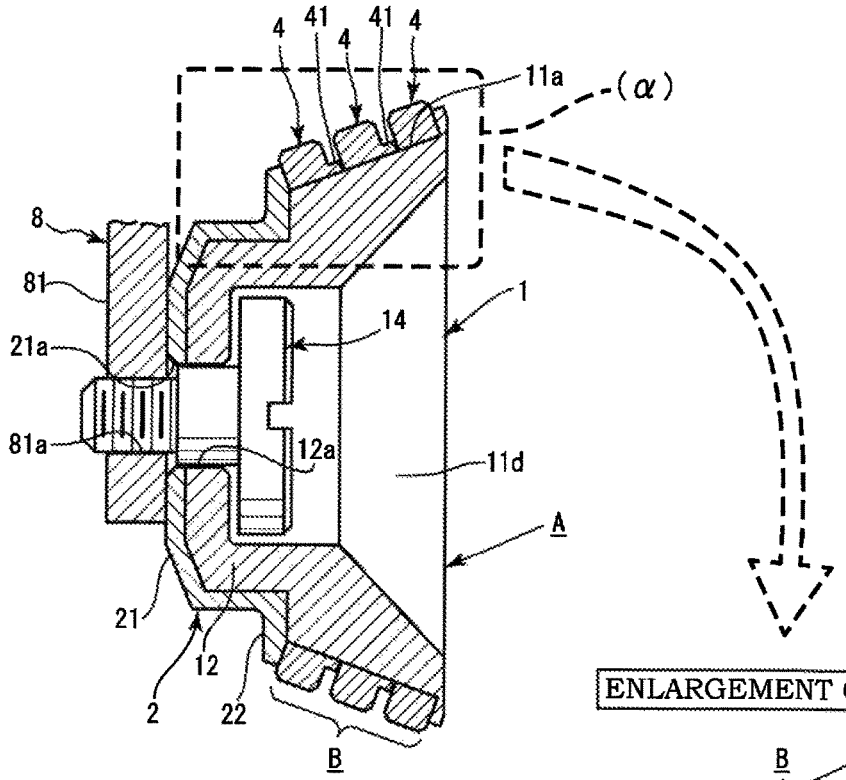
FIG. 5A is a partially cross-sectional side view of a second variation example of the first embodiment of the present invention.
Figure 5B:
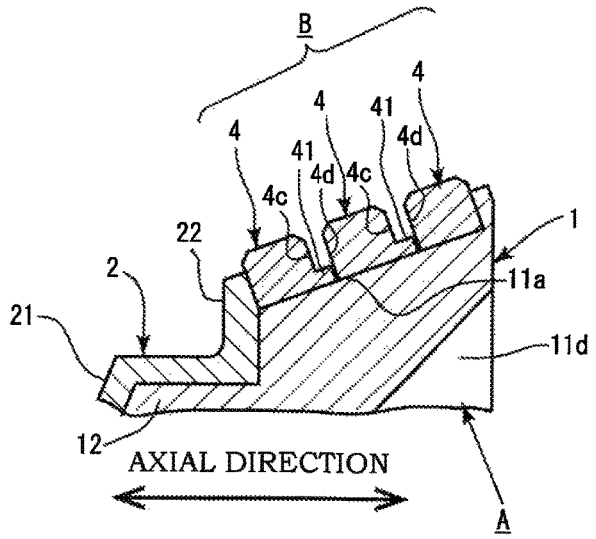
FIG. 5B is an enlarged view of part (a) of FIG. 5A.
Figure 5C:
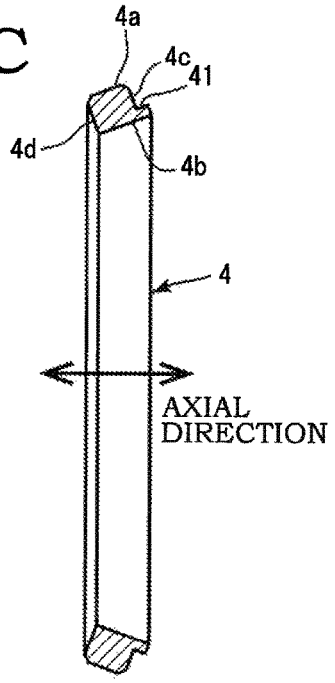
FIG. 5C is a longitudinal cross-sectional side view of the rotating member in the second variation example of the first embodiment of the present invention.

In the second variation example of the first embodiment, as illustrated in FIG. 5A, FIG. 5B and FIG. 5C, a protruding piece 41 is formed on one side face 4*c* orthogonal to the axial direction of the ring-like rotating member 4 that forms the roller part B (see FIG. 5B and FIG. 5C). The protruding piece 41 is a circular continuous protrusion and can abut on the other side face 4*d* orthogonal to the axial direction of the adjacent rotating member 4 in the roller part B (see FIG. 5B and FIG. 5C).

The protruding piece 41 of the rotating member 4 abuts on the side face 4*d* of the adjacent rotating member 4 and serves the function of spacing the adjacent rotating members apart from each other with minimal contact area so that they adjoin in an almost non-contact manner (see FIG. 5B and FIG. 5C). This minimizes interference between adjacent rotating members 4 as they rotate relative to each other and allows each of the rotating members to rotate substantially independently.

Although not illustrated specifically, all of the rotating members 4 may be directly attached to the conical support base member 1 without intermediate support members 5. In this case, a material having an extremely small friction coefficient is preferably used for the rotating members 4. Alternatively, the surface of the rotating members 4 is preferably treated to increase smoothness and to reduce the friction coefficient.

Figure 7A:
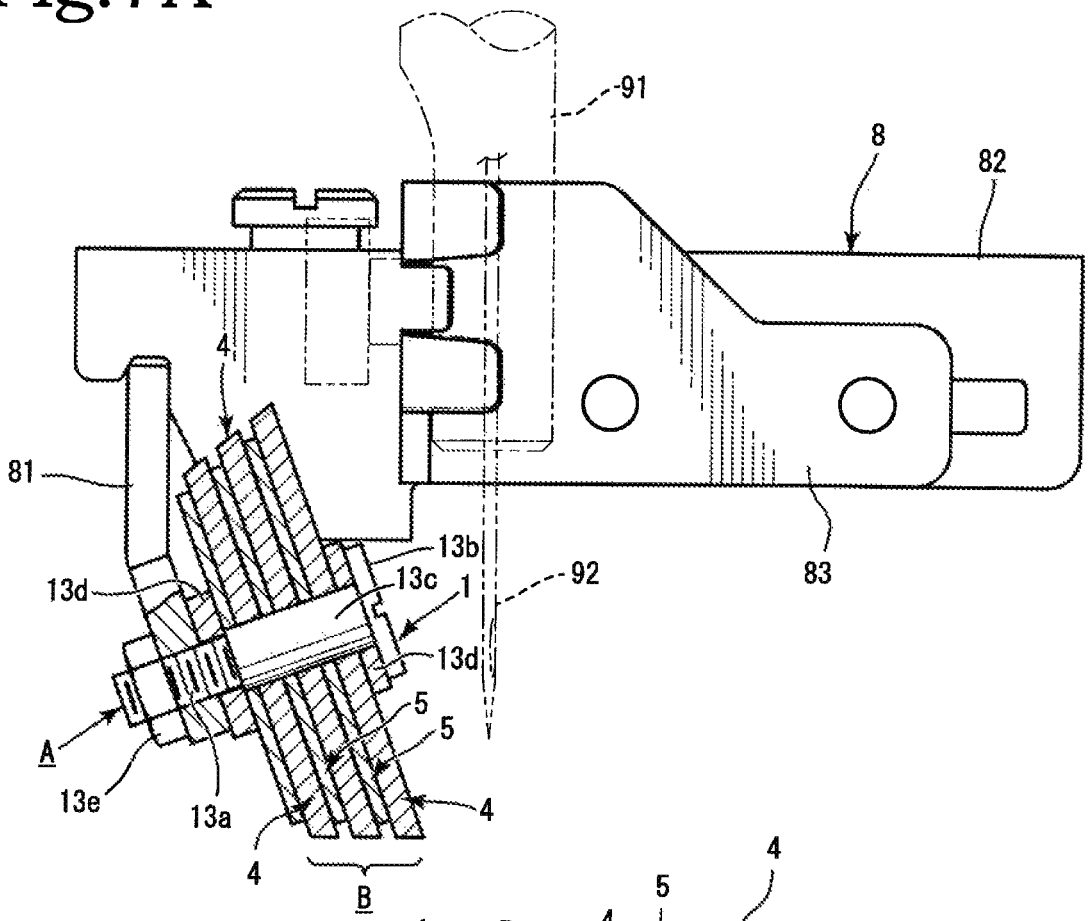
FIG. 7A is a partially cross-sectional side view of a presser foot attached to the shank in a second embodiment of the present invention.
Figure 7B:
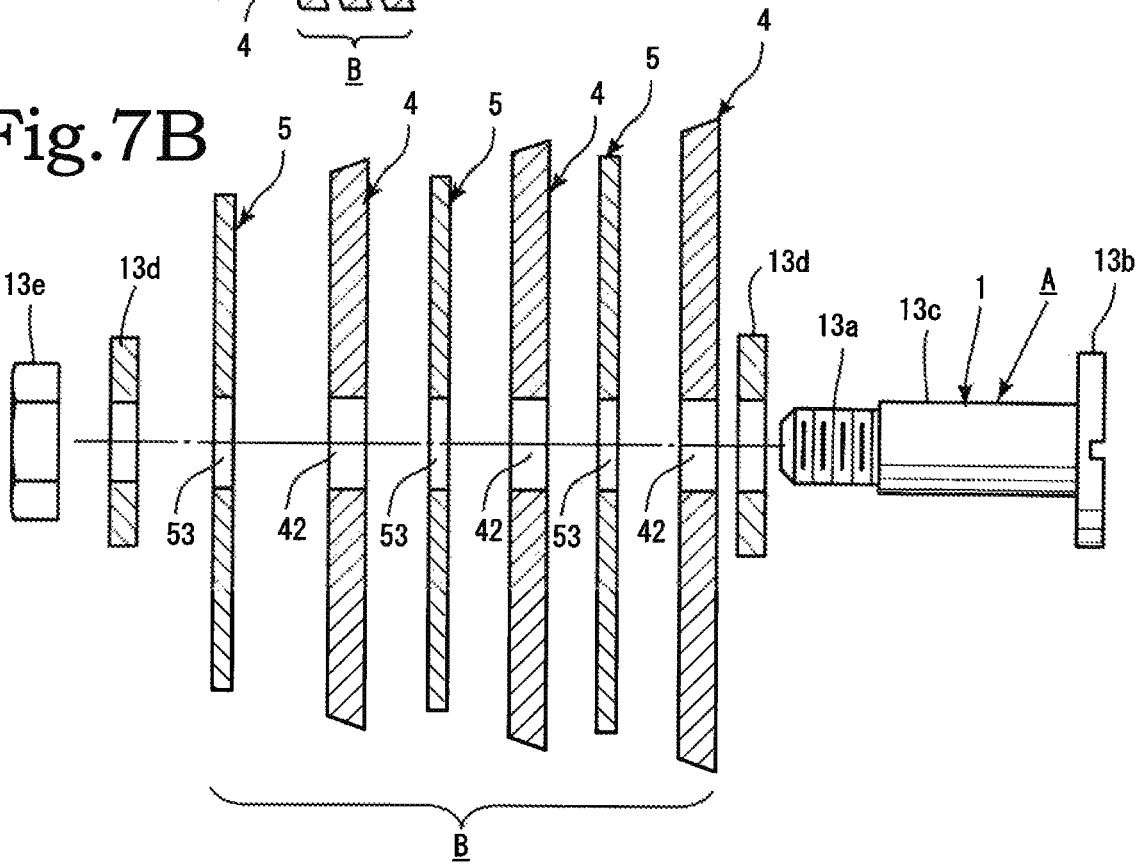
FIG. 7B is an exploded longitudinal cross-sectional side view of the presser foot of the second embodiment of the present invention.

Next, the second embodiment of the present invention will be described. In this embodiment, as illustrated in FIG. 7A and FIG. 7B, the support part A has a support base member 1 that is rod-like in shape (see FIG. 7B). The rod-like support base member 1 is a rod member with a uniform diameter over the entire length (see FIG. 7B). The plurality of rotating members 4 that form the roller part B in the second embodiment are disc-like in shape with different outer diameters, each having a rod through hole 42 at the center (see FIG. 7B).

The intermediate support members 5 in the second embodiment are disc-like plates, each having an outer diameter that is smaller than the outer diameter of the adjacent rotating member 4. Namely, the intermediate support members 5 do not protrude radially out from the adjacent rotating members 4 (see FIG. 7B). A rod through hole 53 is formed in the radial center of each intermediate support member 5. Instead of using the intermediate support members 5, the rotating members 4 may be provided with a protruding piece as in the first embodiment.

The rod through hole 42 and the rod through hole 53 have an inner diameter that is only slightly larger than the outer diameter of the rod-like support base member 1. Specifically, the inner diameter is preferably set such as to allow smooth rotation of the rotating members 4 without any play. The rotating members 4 and the intermediate support members 5 are arranged in the order from the smallest to the largest in diameter, from the base side that is the point of connection with the shank 8 toward the sewing machine needle 92 so that the roller part B is conical as a whole. The rod-like support base member 1 passes through each of the rod through holes 42 and rod through holes 53 (see FIG. 7A).

The rod-like support base member 1 specifically has a stepped bolt-like shape, including an outer threaded part 13*a*, a bolt head 13*b*, and a large-diameter support 13*c* (see FIG. 7B). The large-diameter support 13*c* is a part serving as a rotatable axial support for the roller part B that is made up of the rotating members 4 and intermediate support members 5. The large-diameter support 13*c* is a rod having a uniform diameter over the entire axial length. The rod through holes 42 of all the rotating members 4 have an inner diameter that is set such as to let the large-diameter support 13*c* pass through and to allow the rotating members 4 to rotate smoothly. The rod through holes 42 of all the rotating members 4 have the same inner diameter.

Similarly, the rod through holes 53 of all the intermediate support members 5 have an inner diameter that is set such as to let the large-diameter support 13*c* pass through and to allow the intermediate support members 5 to rotate smoothly. The rod through holes 53 of all the intermediate support members 5 have the same inner diameter. The rod through holes 42 of the rotating members 4 and the rod through holes 53 of the intermediate support members 5 have the same inner diameter (see FIG. 7B). The bolt head 13*b* is formed in the shape of a thin plate. The roller part B, which is formed by the rotating members 4 axially supported on the large-diameter support 13*c*, is held between two washers 13*d*, with a nut 13*e* fastened on the outer threaded part 13*a*.

The presser foot of the present invention is attached to a needle shaft via the shank 8. The plurality of rotating members 4 are attached to the support base member 1 in the order from the smallest to the largest in diameter stepwise so that each of them can press down the fabric to be sewn and configured to each rotate independently. In straight sewing, each of the rotating members 4 can rotate independently at the same outer circumferential speed, which enables favorable sewing of straight stitches. The rotating members 4 each being independently rotatable allows for favorable sewing of not just straight but any desired stitches, as each rotating member 4 rotates while correctly pressing down the fabric to be sewn.

The shank 8 is made up of an arm 81, an attachment body part 82, and a presser foot rod coupler 83. The arm 81 may be foldable to the attachment body part 82. The presser foot rod coupler 83 is a part that is connected to the presser foot rod 91 with a fastener such as a screw. The presser foot rod coupler 83 is configured to be freely slidable horizontally and can be fixed to the attachment body part 82.

The arm 81 has an inner screw hole 81*a* in the distal end portion, which serves the function of coupling the presser foot with the arm 81 by the thread engagement with the threaded rod of the fastener 14 (see FIG. 1B). The sewing machine presser foot of the present invention is attached to the arm 81 of the shank 8, as well as fixed to the presser foot rod 91 via the presser foot rod coupler 83 with a fastener such as a screw (see FIG. 6A and FIG. 6B).

In a second aspect of the present invention, the rotating members each include a protruding piece that is able to slide and abut on the rotating member adjacent thereto. Since the contact area between the rotating members is made small and interference between the rotating members is minimized, the rotating movement of each rotating member can be made favorable.

In a third aspect of the present invention, an intermediate support member is provided between the rotating members that are adjacent to each other. Since adjacent rotating members do not contact each other and do not interfere each other, the rotating movement of each rotating member can be made favorable.

In each of fourth to sixth aspects of the present invention, the support base member has a conical or rod-like shape, which allows for easy formation of a roller part that is conical as a whole.

What is claimed is:

1. A sewing machine presser foot comprising:

a support part having a support base member;

a roller part including a plurality of rotating members rotatably supported at the support base member and having different diameters so that the roller part is conical as a whole, each of the plurality of rotating members individually rotating and pressing a fabric to be sewn; and an intermediate support member provided between the rotating members that are adjacent to each other, the intermediate support member being fixedly mounted to the support base member.

2. The sewing machine presser foot according to claim 1, wherein the support base member has a conical or rod-like shape.

3. The sewing machine presser foot according to claim 1, wherein the support base member is conical as a whole, and has a conical outer circumferential surface on its outer circumference and has a cup-like hollow part in its interior.

4. The sewing machine presser foot according to claim 1, wherein the support base member comprises a rod member with a uniform diameter over an entire length thereof, and wherein a plurality of intermediate support members are provided which comprise disc-like plates, each intermediate support member having an outer diameter that is smaller than an outer diameter of adjacent rotating members, such that the intermediate support member does not protrude radially out from the adjacent rotating members.

* * * * *